United States Patent [19]

Okamoto et al.

[11] Patent Number: 4,712,612

[45] Date of Patent: Dec. 15, 1987

[54] HORIZONTAL STACK TYPE EVAPORATOR

[75] Inventors: Masayoshi Okamoto, Oyamashi; Katsuhisa Suzuki, Utsunomiyashi; Ryoichi Hoshino, Oyamashi; Hironaka Sasaki, Shimodateshi, all of Japan

[73] Assignee: Showa Aluminum Kabushiki Kaisha, Osaka, Japan

[21] Appl. No.: 785,279

[22] Filed: Oct. 7, 1985

[30] Foreign Application Priority Data

Oct. 12, 1984 [JP] Japan ..... 59-214981
Jun. 21, 1985 [JP] Japan ..... 60-136573

[51] Int. Cl.[4] ..... F28F 13/00; F28D 1/02

[52] U.S. Cl. ..... 165/146; 165/153; 165/110; 62/526

[58] Field of Search ..... 165/146, 147, 152, 153, 165/110; 62/515, 526

[56] References Cited

U.S. PATENT DOCUMENTS

| | | | |
|---|---|---|---|
| 1,636,521 | 7/1927 | Ljungstrom et al. | 165/146 |
| 2,782,009 | 2/1957 | Rippingille | 165/153 X |
| 2,899,177 | 8/1959 | Harris et al. | 165/153 |
| 3,161,234 | 12/1964 | Rannenberg | 165/147 X |
| 3,635,283 | 1/1972 | Satchwell | 165/152 X |
| 3,850,234 | 11/1974 | Fowler | 165/153 |
| 4,274,482 | 6/1981 | Sonoda | 165/166 X |
| 4,330,034 | 5/1982 | Lang et al. | 165/146 X |
| 4,501,321 | 2/1985 | Real et al. | 165/153 |

FOREIGN PATENT DOCUMENTS

| | | | |
|---|---|---|---|
| 142466 | 1/1949 | Australia | 165/147 |
| 279868 | 8/1913 | Fed. Rep. of Germany | 165/147 |
| 963780 | 5/1957 | Fed. Rep. of Germany | 165/147 |
| 3215961 | 11/1983 | Fed. Rep. of Germany | 165/153 |
| 913270 | 12/1962 | United Kingdom | 165/147 |

*Primary Examiner*—Albert W. Davis, Jr.
*Assistant Examiner*—Richard R. Cole
*Attorney, Agent, or Firm*—Collard, Roe & Galgano

[57] ABSTRACT

An evaporator is provided having a core portion with an inlet and an outlet; a fluid path for allowing a cooling fluid to pass through, the path being formed in a zigzag form so that the fluid passes through the core portion at least three times; and the fluid path having an increasingly large cross-sectional area from the inlet toward the outlet.

1 Claim, 14 Drawing Figures

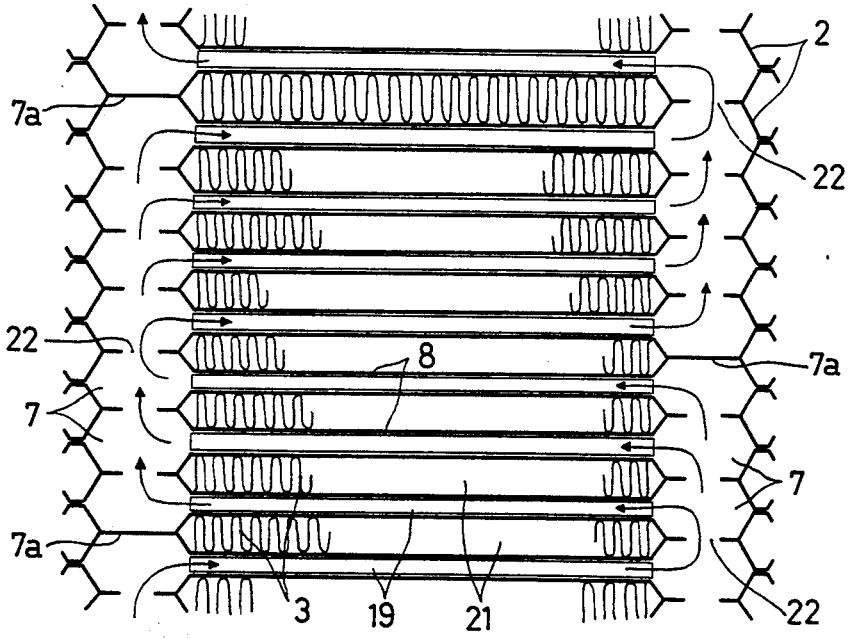
FIG. 3
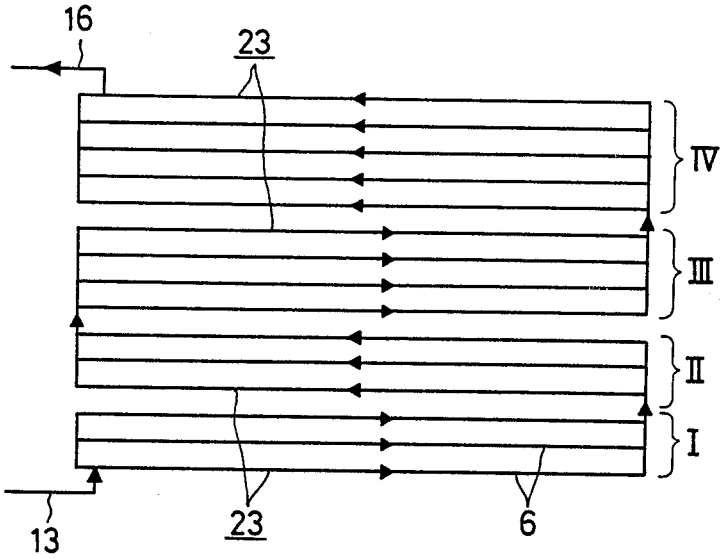

HORIZONTAL STACK TYPE EVAPORATOR

BACKGROUND OF THE INVENTION

1. Field of the Invention

The present invention relates to a heat exchanger, and more particularly, to a heat exchanger for use, for example, as an evaporator for an automobile cooling apparatus.

2. Description of the Prior Art

In general, the evaporators for such use are divided into a variety of types in accordance with how many times a cold fluid passes through the core portion of the evaporator; for example, a two-pass system, a three-pass system and so on.

In order to explain the background of the invention in detail, reference will be made to FIG. 9:

The illustrated evaporator is a two-pass system, in which a plurality of fluid paths 30 are arranged in parallel with air paths being interposed between each path 30 and the next. The cross-sectional areas of the fluid paths 30 are equal.

Half of the fluid paths 30 are connected to an inlet header 31 at their one ends, and the remaining half thereof are connected to an outlet header 32 at their other ends. The opposite ends of all the fluid paths 30 are connected to a common header 33. In this evaporator the cold fluid passes through the core portion of the evaporator with a single U-form turn, which is illustrated as $t_1$ in FIG. 9(B). This means that the fluid passes twice in the core portion along the U-form pathway 40.

The evaporator shown in FIG. 10(A) is a multiple pass system (8 passes). Both ends of the paths 30 are connected to the common header 33 so that each path extends in a U-form $t_2$ as shown in FIG. 10(B). The cold fluid is introduced into the evaporator through the inlet header 31, and passes through the U-form path $t_2$. The cold fluid goes out of the outlet header 32.

The evaporator shown in FIG. 11(A) is a one-pass system. The fluid is introduced into the evaporator through the inlet header 31, from which the fluid is distributed into many paths 30, and gathers in the outlet header 32. In this way the fluid passes only once in the core portion. The reference numerals 34 and 35 denote an inlet port and an outlet port, respectively.

In the evaporator of FIG. 11(A) the fluid tends to flow faster as it comes nearer the inlet and outlet ports 34 and 35. As a result, the efficiency of heat exchange reduces in the areas far from these areas. In this example the fluid flows diagonally along the path $t_3$ as shown in FIG. 11(B), the path $t_3$ connecting between the inlet port 34 and the outlet port 35. In the areas 36 and 37 the efficiency of heat exchange reduces in comparison with the areas 34 and 35 because of the relatively small amount of the fluid.

Another disadvantage is that the fluid is flown out of the evaporator before it is fully used as a coolant because of the shortest path connecting between the inlet port 34 and the outlet port 35. Consequently, the efficiency of heat exchange reduces. On the other hand, in a multiple pass system, such as a two-pass system or a three-pass system, heat exchange takes place evenly throughout the paths, thereby increasing the efficiency of heat exchange.

However, a disadvantage of the multiple pass system is that the fluid is likely to become choked near the outlet because of the fact that the fluid is introduced in an atomized form into the pathway 40 through the inlet header 31, and that the atomized fluid is gradually gasified by absorption of external heat, that portion of gasified fluid varying from 20% at the inlet header, 50% in the middle section, and 100% at the outlet header 32. Owing to gasification the fluid expands in the paths, thereby causing friction against the inside walls of the paths. This prevents the fluid from flowing smoothly, particularly when it comes near the outlet. To overcome the frictional resistance, and a high load occurring because of pressure drop at the inlet side of the evaporator, the compressor must be stepped up so as to supply a sufficiently pressurized fluid to the condenser. Furthermore, the heat exchange efficiency is likely to reduce because of the 'dry-out' in the paths.

OBJECTS AND SUMMARY OF THE INVENTION

The present invention aims at solving the problems pointed out with respect to the evaporators under a known multiple pass system, and has for its object to provide an improved evaporator which enables the compressor to operate on a minimum load without reducing the efficiency of heat exchange.

Other objects and advantages of the present invention will become more apparent from the following description when taken in conjunction with the accompanying drawings which shows, for the purpose of illustration only, one embodiment in accordance with the present invention.

According to the present invention, there is provided a horizontal stack type evaporator:

a core portion having an inlet and an outlet;

a fluid path for allowing a cooling fluid to pass through, the path being formed in a zigzag form so that the fluid passes through the core portion at least three times; and the fluid path having an increasingly large cross-sectional area from the inlet toward the outlet.

BRIEF DESCRIPTION OF THE DRAWINGS

FIG. 2 is a vertical cross-section through the core portion of the evaporator of FIG. 1;

FIG. 3 is a diagrammatic view showing the flow of a fluid in the evaporator of FIG. 1;

DETAILED DESCRIPTION OF THE PREFERRED EMBODIMENT

Figure 1:
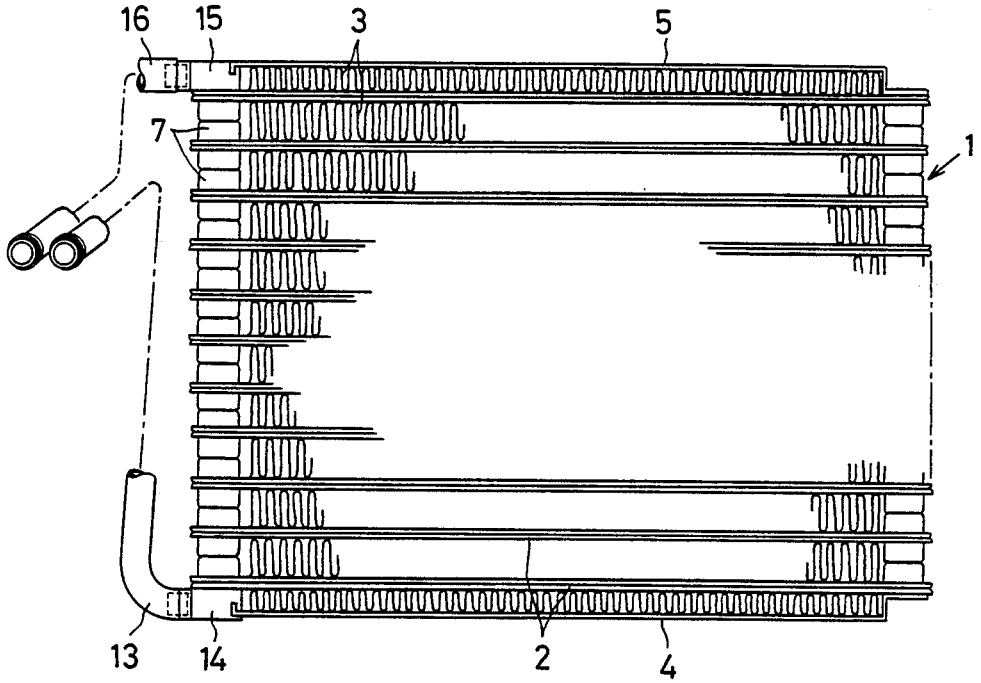
FIG. 1 is a front view showing an evaporator, partly omitted, embodying the present invention.
Figure 4:
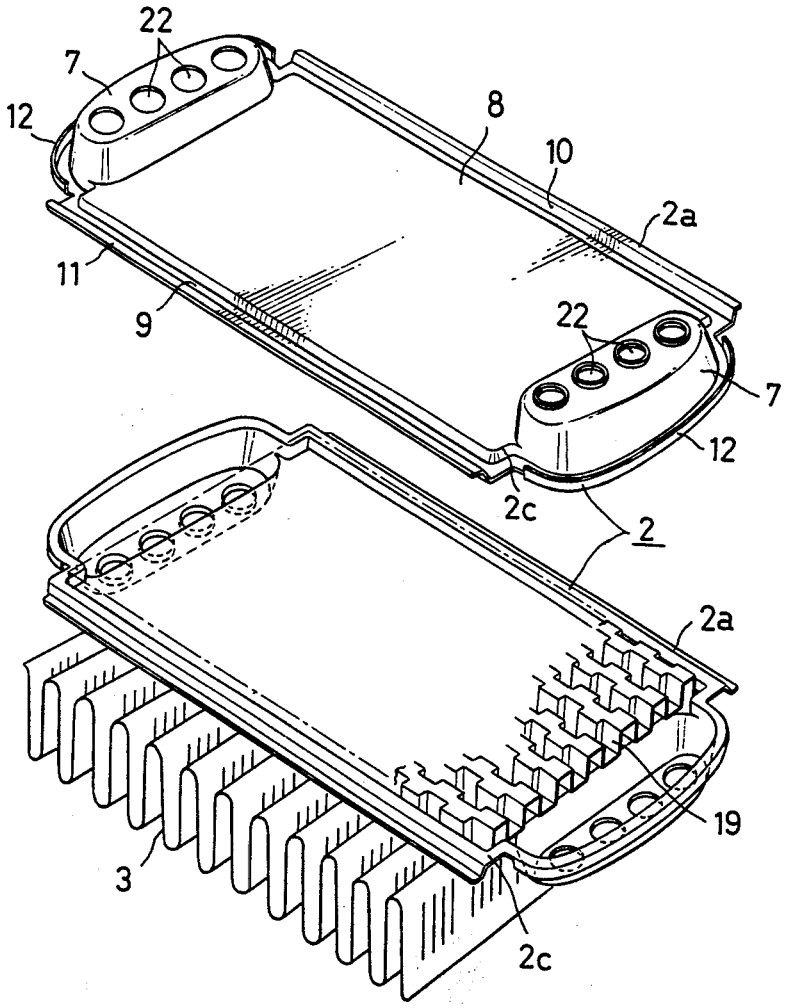
FIG. 4 is an analytical perspective view showing a plate and corrugated-fin pair which constitutes a tubular element.
Figure 8:
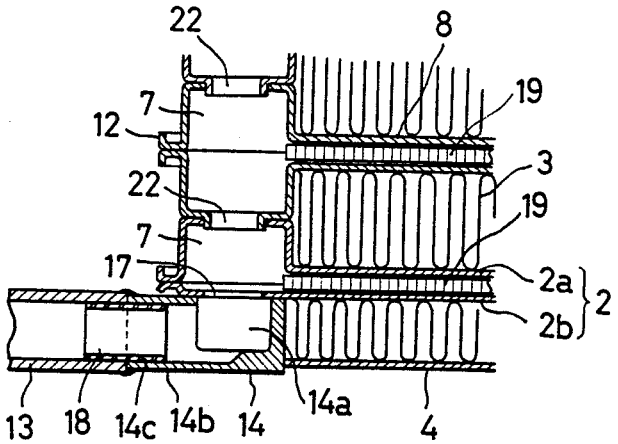
FIG. 8 is a vertical cross-section taken along the line VIII—VIII in FIG. 7.
Figure 9:
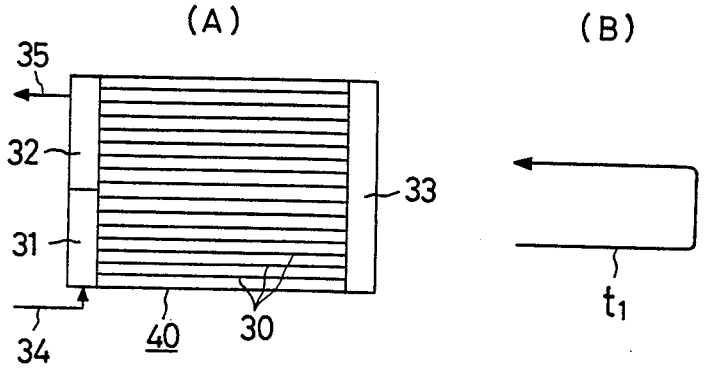
FIGS. 9A and B, 10A and B, and 11A and B are schematic views showing various types of prior art heat exchangers.
Figure 10:
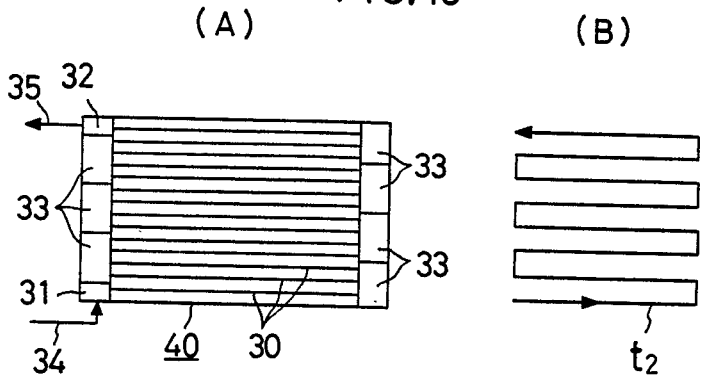
Figure 11:
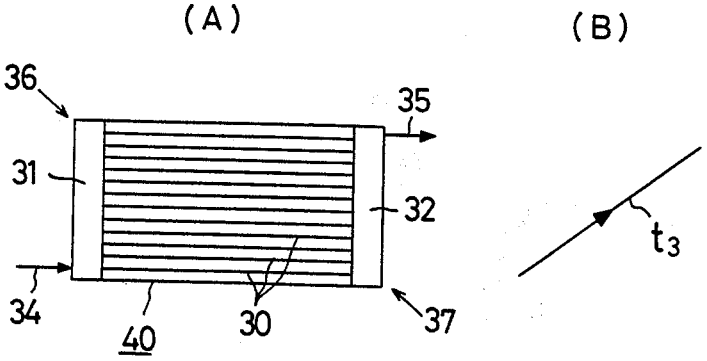

Referring to FIGS. 1 and 2, the evaporator has a core portion 1, which includes a plurality of planar tubular elements 2 and corrugated fins 3 alternately overlaid in a stack. The stack is provided with plates 4 and 5 at its bottom and top, respectively. As shown in FIGS. 4 and 8, each of the lowest and highest tubular elements 2 is formed with a thin molded tray-like plate 2*a* as of aluminium and a virtually flat molded plate 2*b*, and each of the other tubular elements is formed with two tray-like plates. The edge portions of these plates are joined to each other. Each tubular element includes bulged sections 7 at its opposite ends, the bulged sections 7 being connected to each other through a flat tubing 8. The flat tubing 8 forms a unit fluid path 6. The reference numeral 9 denotes troughs formed by bending the opposite side edges of each plate, so as to allow water due to the formation of dew to flow out of the evaporator. The trough 9 has a side wall 10 bent outwardly to such an extent that the bent portion 11 is as high as the top surface of the flat tubing 8. The reference numeral 12 (FIG. 4) denotes reinforcing ribs produced outward of the bulged sections 7. The two tubular elements 2, which are vertically adjacent to each other, are mutually communicated through the bulged sections 7.

The corrugated fins 3 are housed in an air path 21 formed between the upper and lower flat tubings 8 in such a manner that its middle portion is facially joined to the flat tubings 8, with its side edges being joined to the bent portions 11 of the troughs 9. The corrugated fins 3 are normally molded with aluminium. By one suggested process louvers are first fabricated, and then they are fabricated into fins. As described above, the troughs 9 are intended to allow dew water to discharge, thereby ensuring that no splash of dew water leaks in the automobile cabin. The bent portions 11 are joined to the corrugated fins 3, thereby reinforcing the side walls 10 against a detrimental bending or curving. The reinforcing ribs 12 are useful for protecting the tray-like plates 2*a* around the bulged sections 7 against a possible disconnection occurring under the pressure of the fluid flowing therethrough.

As shown in FIG. 3, the plurality of tubular elements 2 are divided, from bottom to top, into four groups (I), (II), (III) and (IV). Each of the groups (I) and (II) has three tubular elements 3, and the group (III) has four. The group (IV) has five. In each group the vertically adjacent tubular elements communicate with each other through the bulged sections 7 each having connecting passages 22. The adjacent groups are joined to each other in one bulged section 7, while the other ends thereof are separated by a partition 7*a*. The passage 22 and the partition 7*a* are alternately provided from group to group. In the embodiment illustrated in Figure 3 the fluid paths 23 are constituted by the abovementioned four groups (I) to (IV). The fluid flows in the directions indicated by the arrows from an inlet pipe 13 to an outlet pipe 16. As evident from FIG. 3, the fluid in one group flows in the same direction; as a whole the fluid flows throughout the core portion in a zigzag way. This is a four-pass system. All the tubular elements 6 have equal cross-sectional areas. However, the number of the tubular elements 6 increases from the group II to the group IV, that is, from three to five. In other words, the amount of the fluid is allowed to increase from the inlet to the outlet.

Under this arrangement, even when the fluid is gasified and increased in volume in the course of flowing through the tubular elements 6, the fluid is enabled to flow in the paths without friction because of the equally increasing capacity provided by the increasing number of fluid paths. The smooth passage of the fluid eliminates the possibility of choking in the fluid paths. In such a favourable situation no high load is required to act on the compressor, thereby saving the energy cost. The choking-free passage of fluid is also effective to eliminate the 'dry-out' problem in the paths, thereby ensuring a high efficiency in the heat exchange.

It is possible to modify the above-described embodiment by increasingly enlarging the cross-sectional area of each tubular element instead of increasing the number of the tubular elements from inlet to outlet, wherein their number is the same throughout the groups.

In the illustrated embodiment of the fluid passes through the bulged sections 7 four times until it flows out of the core portion, that is, a 4-pass system. However, the present invention is not limited to the 4-pass system, but can be applied to a multiple pass system other than it.

Figure 7:
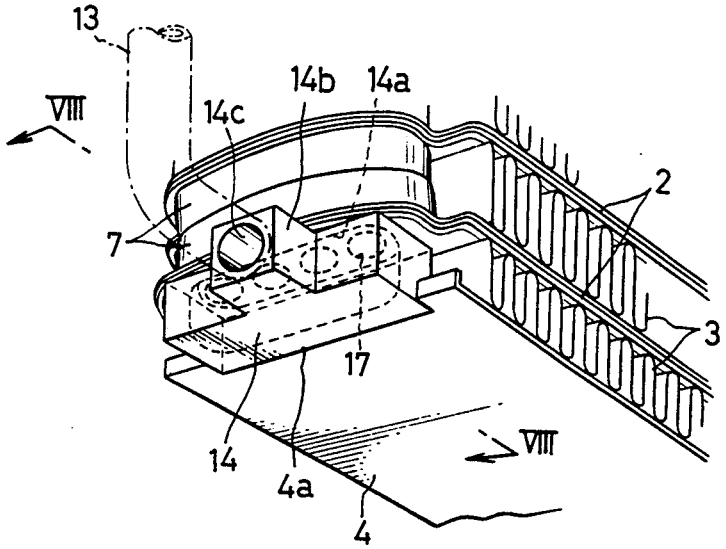
FIG. 7 is a perspective view showing the joint of an inlet header to the core portion of the heat exchanger.

As shown in FIGS. 7 and 8 the inlet header 14 is provided with a recess 14*a* formed crosswise of the tubular element 2, and with a projection 14*b* having a bore 14*c* communicating with the recess 14*a*. The inlet pipe 13 is connected to the bore 14*c*. The bulged section 7 of the bottom tubular element 2 includes several inlet ports 17 located at equal intervals crosswise of the element 2. The inlet header 14 is fixed by brazing to the undersurface of the bulged section of the bottom tubular element 2, wherein the open end of the recess 14*a* is upwardly in such a manner that the recess is communicated with the inlet ports 17. Preferably, a short pipe 18 is used when the inlet pipe 13 is to be connected to the bore 14*c*. Normally, the inlet pipe 13 is joined by soldering or welding to the bore 14*c*. In this way the fluid is initially introduced into the recess 14*a*, and fills it. Then it flows into the bulged section 7 of the bottom tubular element 2 evenly through the inlet ports 17. The even distribution of the fluid contributes to an efficient heat exchange.

In order to locate the inlet header 14 properly with respect to the bottom tubular element 2, a rectangular recess or broken part 4*a* is produced in the edge portion of the plate 4. (FIG. 7) The outlet header 15 having the same structure as that of the inlet header 14 is fixed to the bulged section 7 of the top tubular element 2 and the outlet pipe 16 in the same manner as the inlet header 14 is. Under this structure the fluid is evenly diffused over the width of the tubular elements 2 throughout the core portion 1.

The projections 14*b* and 15*b* are designed to facilitate the joining of the inlet and outlet pipe 13 and 16 to the headers 14 and 15, in than an adequate distance is provided by the projections against the core portion 1. The distance protects the core portion 1 against heat occurring in soldering or welding.

In order to enhance the efficiency of heat exchange, inner fins 19 are provided in the flat tubings 8, which, for example, are of a multi-entry tape. By the use of the inner fins 19 the hot air can contact with the fluid more widely than otherwise, thereby enhancing the efficiency of heat transfer.

Figure 5:
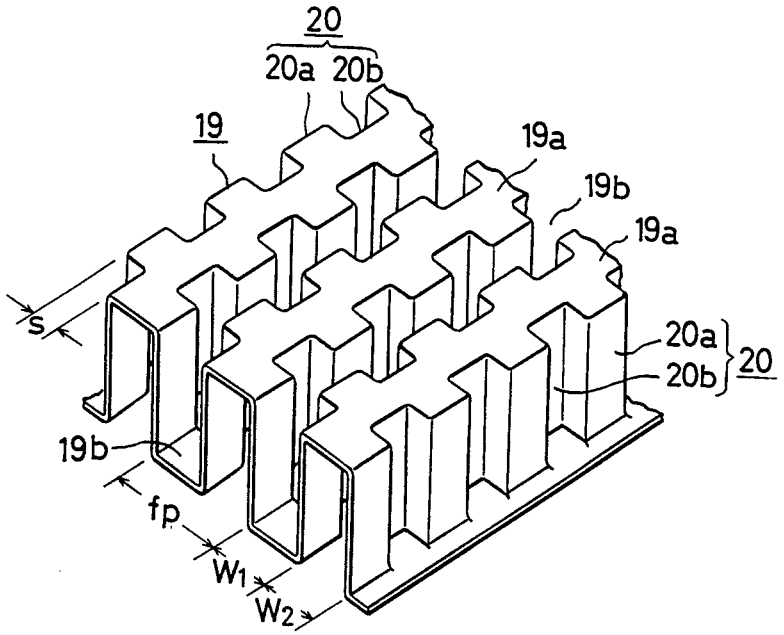
FIG. 5 is a perspective partial view showing a inner fin unit of a multi-entry type incorporated in the tubing element.

As shown in FIG. 5, the inner fin of a multi-entry type is formed by bending a sheet of plate in a zigzag form so that hills 19*a* and valleys 19*b*, each having an equal width $W_1$ and $W_2$, are alternately produced. Both side walls 20 of each hill 19*a* have an uneven surface with convex and concave portions 20*a* and 20*b* alternately produced so that each convex portion is faced to the concave portion of the adjacent hill. In order to obtain a desired result, it is required to determine the fin pitch (fp) in the range of 3.0 to 6.0 mm. If the fin pitch exceeds 6.0 mm, the effect of the increased heat transfer area will be negated, thereby failing to increase the ratio of exchanging heat. If the fin pitch is less than 0.3 mm, the loss of pressure will become large in the fluid paths, and the temperature of the fluid will rise until it reaches an atmospheric temperature, thereby reducing the efficiency of heat exchange. In FIG. 5 the reference character (S) denotes a distance between the top surface of the convex portion 20*a* and the bottom of the concave portion 20*b*. It is preferred to keep the length of the distance (S) in the range of 1/6 to 2/6 of the fin pitch (fp).

Figure 6:
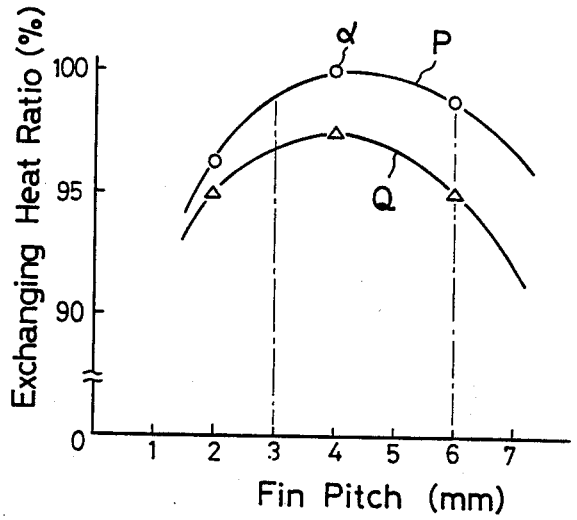
FIG. 6 is a graph showing a relationship between the fin pitch and the resulting ratio of exchanging heat, under a heat exchanger employing inner fins of a multi-entry type, and those of a plain type, respectively.

FIG. 6 shows comparative data on the relationship between the ratio of exchanging heat and the fin pitch (fp). The data was obtained by testing stacked plate evaporators for automobile air-conditioners; one employing inner fins of a multi-entry type, and the other employing those of a plain type fabricated by simply folding a plate in a zigzag form. The graph (P) shows the characteristics curve for the former, and the graph (Q) is for the latter. The 100% is set to the value (a) reached by the ratio of exchanging heat when the fin pitch (fp) is 4.0 mm. As the value (a) for the reference all other values are decided. As evident from FIG. 6, the multi-entry type generally shows higher ratios than the plain type, but when the fin pitch is smaller than 0.3 mm, the ratio for it remarkably reduces because of the increased loss of pressure. The reduced ratio also happens when the fin pitch becomes larger than 6.0 mm because of the reduced area of heat transfer. In conclusion, the multi-entry type exhibits remarkably high ratios of exchanging heat in the range of 3.0 to 6.0 mm in fin pitch.

The inner fins 19 of such a multi-entry type are provided in the flat tubings 8, wherein the valleys 19*b* thereof are arranged in the direction connecting between both bulged sections 7 of each tubular element 2. In order to facilitate this arrangement, the flat tubing 8 is specially designed as described below:

As shown in FIG. 4, the flat tubing 8 is shaped to have a greater width than the bulged sections 7 so that the tubular element 2 can have a shoulder 2*c* at each of the four corners, whereby the inner fin unit 19 is kept in abutment with each shoulder 2 at each corner of the tubular element 2, thereby securing it thereon.

In the illustrated embodiment the tubular elements 2 and the corrugated fins are horizontally arranged, commonly called a horizontally stacked evaporator. The above-described method can be applied to vertically stacked evaporators.

The present invention is not limited to the illustrated embodiments, but can be modified within the scope of the spirit of the invention.

What is claimed is:

1. A horizontal stack type evaporator comprising:

a core portion having an inlet disposed at a lower part thereof and an outlet disposed at an upper part thereof;

a fluid path for allowing a cooling fluid to pass through the core from the lower part to the upper part thereof, the path being a zigzag form so that the fluid passes through the core portion at least three times and comprises a stack which includes a plurality of planar tubular elements and corrugated fins alternately overlaid into a stack form, the tubular elements each having bulged sections at their opposite ends;

flat tubings forming said tubular elements and communicating with the bulged sections, each flat tubing being formed by two molded plates joined along their periphery, each plate including a trough along the periphery formed by bending the periphery of the molded plate;

multi-entry type inner fins arranged in said flat tubings and having a fin pitch ranging from 3.0 to 6.0 mm;

each flow direction of the fluid passing through the core is comprised of a plurality of flat tubings so that a plurality of unit paths result; and the fluid path through the core has an increasingly large cross-sectional area from inlet to outlet.

* * * * *